US008236978B2

(12) United States Patent
Fujino et al.

(10) Patent No.: US 8,236,978 B2
(45) Date of Patent: Aug. 7, 2012

(54) PROCESS FOR PRODUCING SPHINGOMYELIN AND PLASMALOGEN-FORM GLYCEROPHOSPHOLIPID

(75) Inventors: Takehiko Fujino, Fukuoka (JP); Keita Yunoki, Hokkaido (JP); Shiro Mawatari, Fukuoka (JP); Yoshitaka Nadachi, Tokyo (JP)

(73) Assignees: Umeda Jimusho Ltd., Tokyo (JP); Fujino Brain Research, Ltd., Tokyo (JP); Marudai Food Co., Ltd., Takatsuki-shi, Osaka (JP)

( * ) Notice: Subject to any disclaimer, the term of this patent is extended or adjusted under 35 U.S.C. 154(b) by 226 days.

(21) Appl. No.: 12/523,778

(22) PCT Filed: Jan. 23, 2008

(86) PCT No.: PCT/JP2008/051329

§ 371 (c)(1),
(2), (4) Date: Sep. 30, 2009

(87) PCT Pub. No.: WO2008/091015

PCT Pub. Date: Jul. 31, 2008

(65) Prior Publication Data

US 2010/0029966 A1 Feb. 4, 2010

(30) Foreign Application Priority Data

Jan. 26, 2007 (JP) ..... 2007-016056

(51) Int. Cl.
*C11B 1/00* (2006.01)

(52) U.S. Cl. ..... 554/20

(58) Field of Classification Search ..... 554/20
See application file for complete search history.

(56) References Cited

FOREIGN PATENT DOCUMENTS

JP 2006-232967 * 8/2006
JP 2006-232967 9/2006

OTHER PUBLICATIONS

Renagurimusa et al. "Haikei Hyohi FukugoShishitsu no Kinosei Shokuhin Sozai to Shite no Riyo", Japan Society for Bioscience, Biotechnology, and Agrochemistry Hokkaido Branch; The Japanese Society of Soil Science and Plant Nutrition Hokkaido Branch; The Society for Biotechnology, Japan Kita Nihon Branch; The Japanese Society of Carbohydrate Researc.*

(Continued)

*Primary Examiner* — Deborah D Carr
(74) *Attorney, Agent, or Firm* — Nixon & Vanderhye P.C.

(57) ABSTRACT

Disclosed is a process for producing sphingomyelin and plasmalogen-form glycerophospholipid, which comprises the step (A) of extracting a total lipids from a chicken skin powder and drying the extract, the step (B) of subjecting the dried total lipids obtained in said step (A), to extraction treatment with a solvent mixture of an aliphatic hydrocarbon solvent and a water-soluble ketone solvent to separate an insoluble portion composed mainly of sphingomyelin and a soluble portion, the step (C) subjecting the insoluble portion composed mainly of sphingomyelin, obtained in said step (B), to extraction treatment with a solvent mixture of water and a water-soluble ketone solvent to remove a non-lipid component contained in the soluble portion, and the step (D) of drying the soluble portion obtained in said step (B), and subjecting the thus-obtained dried product to extraction treatment with a water-soluble ketone solvent to separate and recover an insoluble portion composed mainly of plasmalogen-form giycerophospholiuld.

According to the above production process, high-purity sphingomyelin, in particular, human-form sphingomyelin and plasmalogen-form sphingomyelin can be produced from chicken skin at high yields with simple procedures.

4 Claims, 2 Drawing Sheets

OTHER PUBLICATIONS

Sangakukan Renkei ni yoru Shokuryo Sangyo to Kasseika no Tame no Shin Gijutsu Kaihatsu Jigyo Heisei 17 Nendo Saitaku Kadai no Gaiyo (1), [online], 2006. 08, Kadai No. H17-20, [retrieval date Mar. 11, 2008].*

Maeba et al, "Ethanolamine plasmalogens prevent the . . . ", Journal of Lipid Research, vol. 44, pp. 164-171 (2003).

Farooqui e al, "Plasmalogens, Phospholipasae $A_2$, and . . . ", Journal of Molecular Neuroscience, vol. 16, pp. 263-272; discussion pp. 279-284 (2001).

Sangakukan Renkei ni yoru Shokuryo Sangyo to Kasseika no Tame no Shin Gijutsu Kaihatsu Jigyo Heisei 17 Nendo Saitakuy Kaidai no Gaiyo (1), ( "New Technology Developing Project for Vitalization of Food Industry, etc, based on Industry-University-Government Collaboration") (Mar. 11, 2008), Internet http://www.s.affrc.go.jp/docs/activation/outline/h17outline.pdf.

Renagurimusa et al., "Haikei Hyohi Fukugo Shishitsu no Kinosei Shokuhin Sozai to Shite no Riyo" ("Use of Skin Complex Lipid of Culled Chickens as Functional Food Material"), Japan Society for Bioscience, Biotechnology, and Agrochemistry Hokkaido Branch—Japanese Society of Soil Science and Plant Nutrition Hoooaido Branch—The Society for Biotechnology, Japan Kita Nihon Branch—The Japanese Society of Carbohydrate Research Hokkaido Branch—The Japanese Society of Nutrition and Food Science Hokkaido Branch Hokkaido Nogei Kagaku Kyokai Godo Gakujutsu Koenkai Koen Yoshi, (2006), p. 12.

International Search Report for PCT/JP2008/051329, mailed Mar. 25, 2008.

Written Opinion for the International Searching Authority mailed Mar. 25, 2008.

Renagurimusa et al., "Haikei Hyohi Fukugo Shishitsu no Kinosei Shokuhin Sozai to Shite no Riyo", Japan Society for Bioscience, Biotechnology, and Agrochemistry Hokkaido Branch—Japanese Society of Soil Science and Plant Nutrition Hoooaido Branch—The Society for Biotechnology, Japan Kita Nihon Branch—The Japanese Society of Carbohydrate Research Hokkaido Branch—The Japanese Society of Nutrition and Food Science Hokkaido Branch Hokkaido Nogei Kagaku Kyokai Godo Gakujutsu Koenkai Koen Yoshi, (2006), p. 12.

Sangakukan Renkei ni yoru Shokuryo Sangyo To Kasseika no Tame no Shin Gijutsu Kaihatsu Jigyo Heisei 17 Nendo Saitakuy Kaidai no Gaiyo (1), (Mar. 11, 2008), Internet http://www.s.affrc.go.jp/docs/activation/outline/h17outline.pdf.

* cited by examiner

PROCESS FOR PRODUCING SPHINGOMYELIN AND PLASMALOGEN-FORM GLYCEROPHOSPHOLIPID

This application is the U.S. national phase of International Application No. PCT/JP2008/051329 filed 23 Jan. 2008, which designated the U.S. and claims priority to JP Application No. 2007-016056 filed 26 Jan. 2007, the entire contents of each of which are hereby incorporated by reference.

TECHNICAL FIELD

This invention relates to a process for producing a sphingomyelin, in particular a human-form sphingomyelin, and a piasmalogen-form glycerophospholipid useful as a functional food material, a medical material, a cosmetic material, from chicken skin by a simple method at high yields, and to a sphingomyelin and a plasmalogen-form glycerophospholipid obtained by the above process.

BACKGROUND ART

Lipid refers to a substance that has a long-chain fatty acid or similar hydrocarbon chain in a molecule and that is present in an organ or derived from a zoic organ. The lipid can be classified into simple lipid and complex lipid. The simple lipid is composed of C, H and O and is generally soluble in acetone, and triacylglycerol as a simple lipid is present as an energy reservoir in a fat tissue of an animal body. On the other hand, the complex lipid is a group of lipid containing P of phosphoric acid, N of a baser etc. Therefore, the complex lipid is composed of a hydrophobic part (fatty acid part) and a hydrophilic part (phosphoric acid and base parts) and exhibits amphophilic nature. Generally, the above simple lipid is soluble in acetone, while the complex lipid is insoluble in acetone. Such complex lipid is a constituent of a biomembrane.

The above complex lipid can be classified into (1) glycerophospholipid [which phosphatidylcholine (alias lecithin), phosphatidylethanolamine, etc., belong to], (2) sphingophospholipid (which sphingomyelin, ceramide ciliatine, etc., belong to), (3) sphingoglycolipid (which cerebroside, sulfatide, ganglioside, etc., belong to) and (4) glyceroglycolipid (which includes lipids in which various saccharides bond to diacyl glycerol existing in mirorganism or higher plant). The above (2) sphingophospholipid and (3) sphingoglycolipid are generically referred to as "sphingolipid".

The above glycerophospholipid is a generic term for lipids having glycerophosphoric acid backbone in their structure, and includes phosphatidylcholine (lecithin), phosphatidylethanolamine, diphosphatidylglycerol, etc. Many lipids belonging to this glycerophospholipid are those in which the non-polar portion is a fatty acid ester, while some are of a plasmalogen-form having a vinyl ether bond.

The above glycerophospholid is important as a constituent of biomembrane, and above all, the plasmalogen-form glycerophospholipid has high radical sensitivity by its vinyl-ether bond and is hence in recent years highlighted as a phospholipid having anti-oxidation nature. It is recently reported that the plasmalogen-form glycerophospholipid contributes to oxidation-stability of phospholipid membrane containing cholesterol through a mechanism different from the counterpart of α-tocopherol that is an anti-oxidation constituent of cell membrane (for example, see "J. Lipid Res.", Vol. 44, pages 164-171 (2003)). Further, it is also pointed out that the plasmalogen-form glycerophospholipid not only takes part in the oxidation resistance of cell membrane and lipoprotein, but also has an important role in the information communication system of cells (for example, see "J. Mol. Neurosci.", Vol. 16, pages 263-272; discussion pages 279-284 (2001)).

The above plasmalogen-form glycerophospholipid is expected to have the function of preventing the death of brain nerve cells in dementia. Under the circumstances, however, there is found no safe supply source that is safe and makes a large amount available.

On the other hand, the sphingoiipid is a generic term for lipids having a long-chain base such as sphingosine, and it is composed mainly of sphingoglycolipid and sphlngophospholipid as described already. The sphingoglycolipid contains a long-chain base such as sphingosine or fat sphingosine in addition to saccharide and long-chain fatty acid. The simplest sphingoglycolipid is cerebroside, and it includes sulfatide in which a sulfuric acid group is bonded thereto, ceramide oligohexoside in which several molecules of neutral saccharide are bonded, ganglioside in which sialic acid is bonded, etc. These lipids are present in cell cortex and are thought to take part in a recognitive mechanism.

The sphingophospholipid is classified into a derivative of ceramide 1-phosphoric acid and a derivative of ceramide 1-phosphonic acid. As the former, sphingomyeline is well known, and as the latter, ceramide ciliatine (ceramide aminoethylphosphonic acid).

These sphingolipids are spotlighted since it has been shown in recent years that ceramide, sphingosine, sphingosine-1-phosphoric acid, etc., which are decomposition metabolites thereof, take part in the information communication in cells. Further, the sphingolipids take part in the formation of a membrane microdomain called "raft" together with cholesterol, etc., and it has been shown that this microdomain plays an important role as a site of information communication, so that more and more attention has been paid thereto.

These sphingolipids have been conventionally extracted from cow brains and utilized, while those which are derived from cereals or fungi are now used from a safety standpoint. Since, however, sphingold bases constituting sphingolipids derived from cereals or fungi differ from those of mammals, there is a problem that their utility in organisms is low as compared with human-form sphingolipids.

Meanwhile, when a relatively large amount of sphingomyelin is produced from total lipids of foods, animal tissues, etc., it is produced by eluting it stepwise by means of column chromatography using silicic acid, etc., or by fractionating it stepwise according to a solvent fractionation method. Both of these require complicated procedures. In the solvent fractionation method, it is general practice to employ a method in which acetone is added to total lipids to precipitate complex lipid (phospholipid) (insoluble portion), the insoluble portion is washed with ether to remove glycerophospholipid, and the residue is taken as a sphingolipid fraction. This fraction contains not only sphlngomyelin but also glycerosphingolipids such as cerebroside.

On the other hand, it is known that the phospholipid of chicken-skin contains much human-form spingomylelin and plasmalogen-form glycerophospholipid.

DISCLOSURE OF THE INVENTION

Under the circumstances, it is an object of this invention to provide a process for producing high-purity sphingomyelin, in particular human-form sphingomyelin and plasmaiogn-form glycerophospholipid, from chicken-skin by simple procedures at high yields.

For achieving the above object, the present inventors have made diligent studies, and as a result found that the above object can be achieved by applying specific steps to chicken skin powder. On the basis of this finding, this invention has been accordingly completed.

That is, this invention provides (1) a process for producing sphingomyelin and plasmalogen-form glycerophospholipid, which comprises the step (A) of extracting total lipids from a chicken skin powder and drying the extract, the step (B) of subjecting the dried total lipids obtained in said step (A), to extraction treatment with a solvent mixture of an aliphatic hydrocarbon solvent and a water-soluble ketone solvent to separate an insoluble portion composed mainly of sphingomyelin and a soluble portion, the step (C) subjecting the insoluble portion composed mainly of sphingomyelin, obtained in said step (B), to extraction treatment with a solvent mixture of water and a water-soluble ketone solvent to remove a non-lipid component contained in the soluble portion, and the step (D) of drying the soluble portion obtained in said step (B), and subjecting the thus-obtained dried product to extraction treatment with a water-soluble ketone solvent to separate and recover an insoluble portion composed mainly of piasmalogen-form glycerophospholipid, (2) a process as recited in the above (1), wherein the solvent mixture in the step (B) contains n-hexane and acetone at a volume ratio of 4:6 to 6:4, and its use amount is 10 to 30 mL per gram of the dried total lipids, (3) a process as recited in the above (1) or (2), wherein the water-soluble ketone solvent in the step (C) is acetone and the solvent mixture contains water and acetone at a volume ratio of 3:7 to 7:3, and its use amount is 10 to 30 mL per gram of a dried product from the insoluble portion composed mainly of sphingomyelin, obtained in the step (B), (4) a process as recited in the above (1) or (2), wherein the water-soluble ketone solvent in the step (D) is acetone, and its use amount is 10 to 30 mL per gram of a dried product from the soluble portion obtained in the step (B), (5) sphingomyelin obtained by using the process recited in any one of the above (1) to (3), and (6) plasmalogen-form glycerophospholipid obtained by using the process recited in the above (1), (2) or (4)

Effecti of the Invention

According to this invention, there can be provided a process for producing a sphingomyelin, in particular a human-form sphingomyelin and a plasmalogen-form glycerophospholipid useful as a functional food material, a drug material, a cosmetic material, etc., from chicken skin by simple procedures at high yields. Further according to this invention, there can be provided a sphingomyelin and plasmalogen-form glycerophospholipid obtained by the above process.

BEST MODES FOR PRACTICING THE INVENTION

Figure 1:
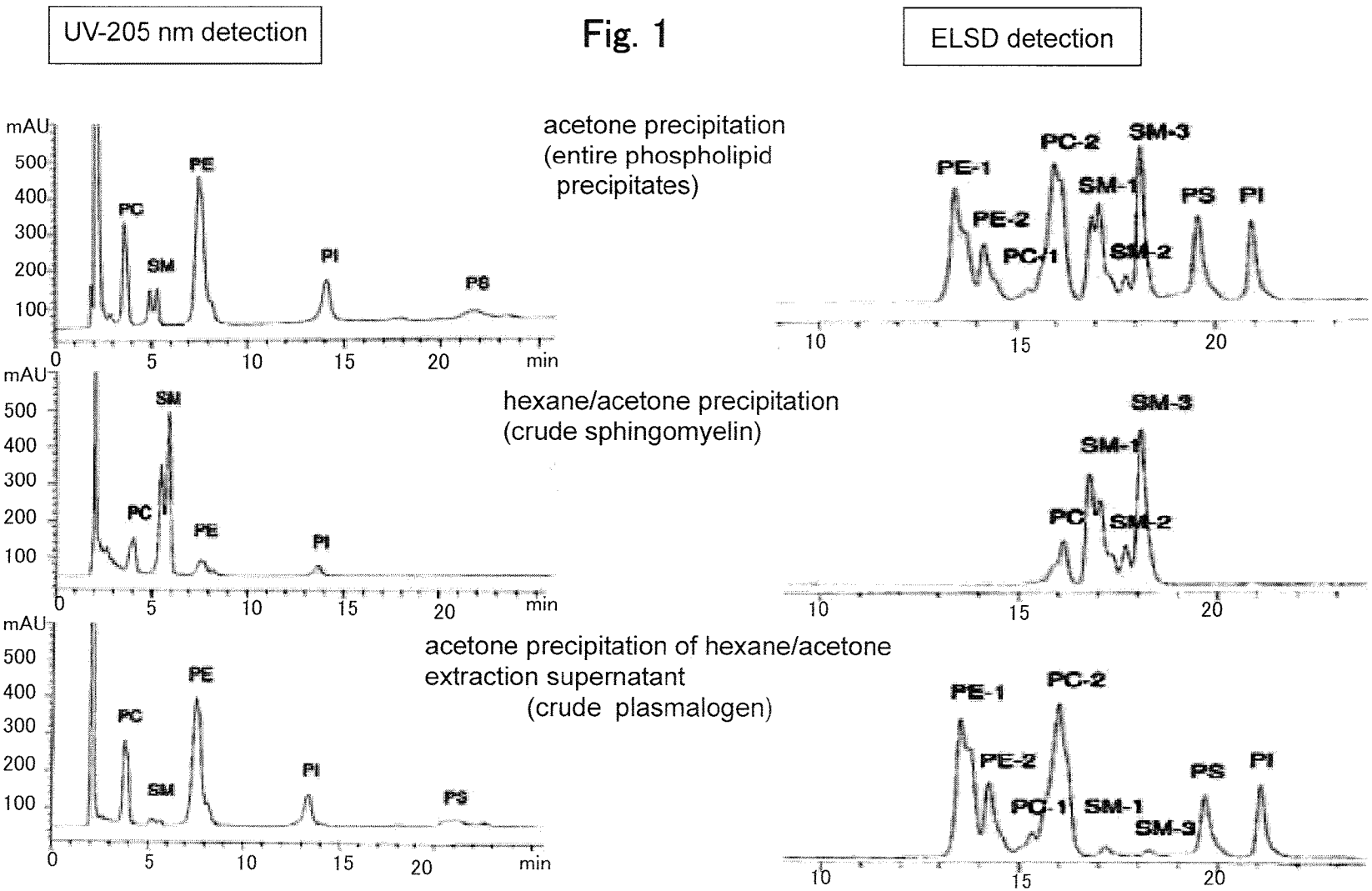
FIG. 1 shows UV-205 nm detection chromatograms and ELSD detection chromatograms of substances obtained by various steps.

The process for producing sphingomyelin and plasmalogen-form glycerophospholipid, provided by this invention, comprises the followings steps (A), (B), (C) and (D).

[Step (A)]

This step (A) is a step in which total lipids are extracted from a chicken skin powder and dried. In this step (A), a chicken skin powder is first prepared. In this case, chicken skin is directly powdered, or it may be defatted to remove a fat content to some extent as required and a defatted material may be powdered. For the defatting treatment of chicken skin, there may be employed a mechanical method, a method of immersion in hot water under heat, a direct heating method, a method using an aliphatic hydrocarbon solvent (n-hexane), or the like.

Then, total lipids are extracted from the thus-obtained chicken skin powder in a solvent and dried to obtain dried total lipids. As a solvent for extracting the total lipids, a solvent that is safe in food sanitation and also excellent in extraction efficiency is used. In particular, ethanol is suitable therefor. This extraction treatment can be carried out according to a conventional method. In this extraction step, however, non-lipid components soluble in ethanol are also extracted.

The dried total lipids can be obtained from an extract according to a conventional method by distilling off a solvent by means of a rotary evaporator, etc., or introducing nitrogen gas.

[Step (B)]

This step (B) is a step in which the dried total lipids obtained in the above step (A) are subjected to extraction treatment with a solvent mixture of an aliphatic hydrocarbon solvent and a water-soluble ketone solvent to separate an insoluble portion composed mainly of sphingomyelin (to be sometimes referred to as "crude sphingomyelin" hereinafter) and a soluble portion.

Examples of the aliphatic hydrocarbon solvent as one component in the solvent mixture that is used for the extraction treatment of the dried total lipids include n-pentane, isopentane, n-hexane, isohexane, n-heptane, isoheptane, cyclopentane, cyclohexane, etc., and these may be used singly or as a mixture of two or more of them. Of these, n-hexane is suitable.

As the water-soluble ketone solvent that is the other component of the above solvent mixture, for example, acetone and/or methyl ethyl ketone may be used. Of these, acetone is suitable.

When a mixture of n-hexane and acetone is used as a solvent mixture, the amount ratio thereof by volume is preferably 4:6 to 6:4, more preferably 4.5:5.5 to 5.5:4.5.

Further, the amount of the solvent mixture for use is normally approximately 10 to 30 ml per gram of the dried total 7 lipids. When the above amount of the solvent mixture is less than 10 mL, the extraction treatment cannot be fully carried out, and the purity and yield of sphingomyelin in the insoluble portion may be decreased. When it exceeds 30 mL, there may not be produced any further effect on improvements of the purity and yield of sphingomyelin in proportion to that amount. The amount of the solvent mixture for use is preferably 15 to 25 mL per gram of the dried total lipids. The extraction treatment can be carried out according to a conventional method.

The liquid obtained after extraction treatment can be separated by centrifugal treatment into a soluble portion and an insoluble portion composed mainly of sphingomyelin.

[Step (C)]

The step (C) is a step in which the insoluble portion composed mainly of sphingomyelin, obtained in the above step (B), is subjected to extraction-treatment with a solvent mixture of water and a water-soluble ketone solvent to remove a non-lipid component contained in the soluble portion.

The purity of crude sphingomyelin in the insoluble portion composed mainly of sphingomyelin, obtained in the above step (B), is normally 40 mass % or more. In this crude sphingomyelin, normally, 6 mass % or less of phosphatidylcholine is included besides sphingomyelin, while other phospholipids are hardly contained.

The water-soluble ketone solvent in the step (C) is preferably acetone, and when water and acetone are used as a mixed solvent, the volume ratio thereof is preferably 3:7 to 7:3, more preferably 5:5. Further, the amount of the mixed solvent that is used per gram of the dried product from the insoluble portion composed mainly of sphingomyelin, obtained in the step (B), is approximately 10 to 30 mL.

The liquid obtained after extraction treatment can be separated by centrifugal treatment into a soluble portion and an insoluble portion composed mainly of sphingomyelin. Then, water remaining in the insoluble portion can be removed by acetone treatment. The resultant crude sphingomyelin normally has a purity of 70 mass % or more. In this crude sphingomyelin, normally, 12 mass % or less of phosphatidylcholine is included besides sphingomyelln, while other phospholipids are hardly contained.

[Step (D)]

The step (D) is a step in which the soluble portion obtained in the above step (B) is dried, and the thus-obtained dried product is subjected to extraction treatment with a water-soluble ketone solvent to separate and recover an insoluble portion composed mainly of plasmalogen-form giycerophospholipid (to be sometimes referred to as "crude plasmalogen-form glycerophospholipid" hereinafter).

In this step (D), first, the soluble portion obtained in the above step (B) is dried according to a conventional method. For example, there may be employed a method in which the solvent mixture in the above soluble portion is distilled off by means of a rotary evaporator. Then, the thus-obtained dried product is subjected to extraction treatment with a water-soluble ketone solvent according to a conventional method. As the water-soluble ketone solvent used in this case, acetone and/or methyl ethyl ketone can be employed, and acetone is preferred.

When acetone is used as an extraction solvent, its amount per gram of the dried product is normally approximately 10 to 30 mL. When the amount thereof in use is less than 10 mL, no sufficient extraction treatment can be carried out, which may lead to a decrease in the purity and the yield of plasmalogen-form glycerophospholipid in the insoluble portion. When it exceeds 30 mL, there is not produced any further effect on improvements of the purity and yield of plasmalogen-form glycerophospholipid in proportion to that amount. The amount of the solvent per gram of dried product is 15 to 25 mL.

The liquid obtained after extraction treatment can be separated by centrifugal treatment to a soluble portion and an insoluble portion composed mainly of plasmalogen-form glycerophospholipid (crude plasmalogen-form glycerophospholipid) The amount of plasmalogen-form glycerophospholipid in the insoluble portion is normally 40 mass % or more.

According to the above process of this invention, sphingomyelin and plasmalogen-form glycerophospholipid having high purity each can be produced from total lipids of chicken skin at high yields by simple means.

According to the process of this invention, normally, approximately 0.25 to 0.40 mass % of crude sphingomyelin and approximately 1.2 to 2.0 mass % of crude plasmalogen-form glycerophospholipid can be obtained from a dry powder of chicken skin.

Sphingomyelin includes a phosphoric diester bond formed by a primary-alcoholic hydroxyl group of ceramide and choline phosphoric acid, has a structure of the following formula (I), (I)

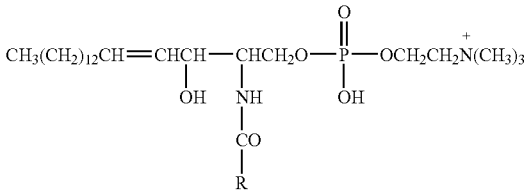

(wherein R—CO is a fatty acid residue) and normally is present widely not only in brain tissues but also in organ tissues.

Since most of sphingoid bases constituting the sphingomyelin derived from chicken skin, obtained by the process of this invention, is 4-trans-sphingenin (sphingosine), this sphingomyelin is a human-form sphingomyelin having high bioavailability.

It has been reported that sphingomyelin as ceramide, sphingosin, sphingosin-l-phosphoric acid, etc., which are metabolites produced by decomposition thereof, participates in information communication in lipids, and it has been also revealed that sphingomyelin participates in the formation of a membrane microdomain called "raft", and that the microdomain performs an important role as an information communication site. Further, sphingomyelin is expected to have a skin moisture-retaining effect, an effect of preventing a large intestine cancer, and the like.

The crude plasmalogen-form glycerophospholipid obtained by the process of this invention mainly contains phosphatidylethanolamine (PE) and partially contains phosphatidylcholine (PC) Approximately 80 mass % of the above PE is plasmalogen-form, and PC contains approximately 30 mass % of a plasmalogen-form.

The following formulae (II) and (III) show structures of diacyl type glycerophospholipid and plasmalogen-form glycerophospholipid, respectively.

(II)

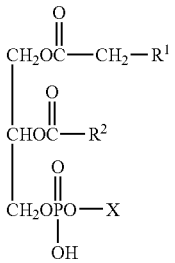

(III)

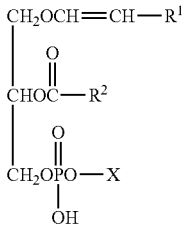

$R^1$, $R^2$=long-chain fatty acid group.

$$X = \text{—}CH_2CH_2NH_2,\ \text{—}CH_2CH_2\overset{+}{N}(CH_3)_3$$

Generally glycerophospholipid (lecithin) has an ester bond with an acyl group of a fatty acid in sn-1 (1 position) of glycerol as shown in the formula (II), while a plasmalogen-form has a vinyl ether bond having an alkenyl group in sn-1 of glycerol as shown in the formula (III).

When X is an amonoethyl group, it is a phosphatidylethanolamine, and when X is a trimethylaminoethyl group, it is phosphatidylcholine.

The above plasmalogen-form glycerophospholipid attracts attention as an oxidation-resisting phospholipid since its vinyl ether bond has high radical sensitivity, and it is known that it contributes to oxidation stability of a phospholipid membrane containing cholesterol. Further, it has been pointed out that the plasmalogen-form glycerophospholipid not only takes part in the oxidation resistance of cell membrane and lipoprotein but also plays an important role in the information communication system of cells. The above plasmalogen-form glycerophospholipid is expected to work to prevent the neurocyte death of a brain in dementia or have an effect on the prevention of the crisis of atherosclerosis.

According to the present invention, there are also provided a sphingomyelin and a plasmalogen-form glycerophospholipid which are obtained by the above process of this invention.

EXAMPLE

This invention will be explained further in detail hereinafter with reference to Example, while this invention shall not be limited by the Example.

Example 1

Four hundred Grams of a freeze-dried chicken skin powder was extraction-treated with 1,000 mL of ethanol as an extracting solvent, and then the resulting extract was dried with a rotary evaporator to give 80 g of total lipids.

To the dried total lipids were then added 20 mL, per gram thereof, of a solvent mixture of n-hexane/acetone (volume ratio 1/1), and an extraction treatment was carried out under ice cooling for 1 hour.

Then, the liquid obtained after the extraction treatment was subjected to centrifugal separation at 1,000 G for 10 minutes to separate a soluble portion as a supernatant and a precipitate (insoluble portion). To the above precipitate was added 20 mL, per gram thereof, of a 50% aqueous acetone solution, and the mixture was fully stirred and then subjected to centrifugal separation at 1,500 G for 10 minutes to separate an insoluble portion in a supernatant and a precipitate (insoluble portion). Further, to the precipitate was added 20 mL, per gram thereof of acetone, and the mixture was stirred and then subjected to centrifugal separation at 1,500 G for 10 minutes to separate an insoluble portion in a supernatant and a precipitate (insoluble portion). Most of this precipitate was sphingomyelin (crude sphlngomyelin).

Then, to the dried product obtained by drying the above soluble portion with a rotary evaporator was added 20 mL, per gram thereof, of acetone, and the dried product was extraction-treated. Then, the resulting extract was subjected to centrifugal separation at 1,000 G for 10 minutes to separate a soluble portion as a supernatant and a precipitate (insoluble portion). As the insoluble portion, phospholipid having sphingomyelin removed therefrom was obtained, and most of it was plasmalogen-form glycerophospholipid (crude piasmalogen-form glycerophospholipid).

Crude sphingomyelin and crude piasmalogen-form glycerophospholipid (to be sometimes simply referred to as "crude plasmalogen" hereinafter) were obtained from a dry powder of chicken skin in the above manner, and as a result of this experiment which was repeated eight times, 25.6±2.8 g of total lipids and 20.5±3.4 g of neutral lipid were obtained from 40 g of a dry powder of chicken skin. The recovery of the crude plasmalogen was 0.65±0.09 g, and the recovery of the crude sphingomyelin was 0.13±0.02 g.

FIG. 1 shows UV-205 nm detection chromatograms and ELSD detection chromatograms of substances obtained by the above steps. It is shown that when total lipids of chicken skin are subjected to precipitation treatment with only acetone (1 g/20 mL), the entire phospholipid precipitates, but that when a precipitate obtained by treating total lipids with n-hexane:acetone (1:1) (1 g/20 mL) once is subjected to extraction treatment with a 50% aqueous acetone solution, sphingomyelin is nearly selectively precipitated (crude sphingomyelln). In the ELSD detection chromatogram, this crude sphingomyelin includes approximately 11 mass % of phosphatidylcholine, while no other phospholipid is detected. It is further shown that when a supernatant (soluble portion) is dried and then treated with acetone (1 g/20 mL) after the precipitation treatment with hexane:acetone (1:1), phospholipid in which most of sphingomyelin has been removed from the total lipids, is precipitated (crude plasmalogen).

Figure 2:
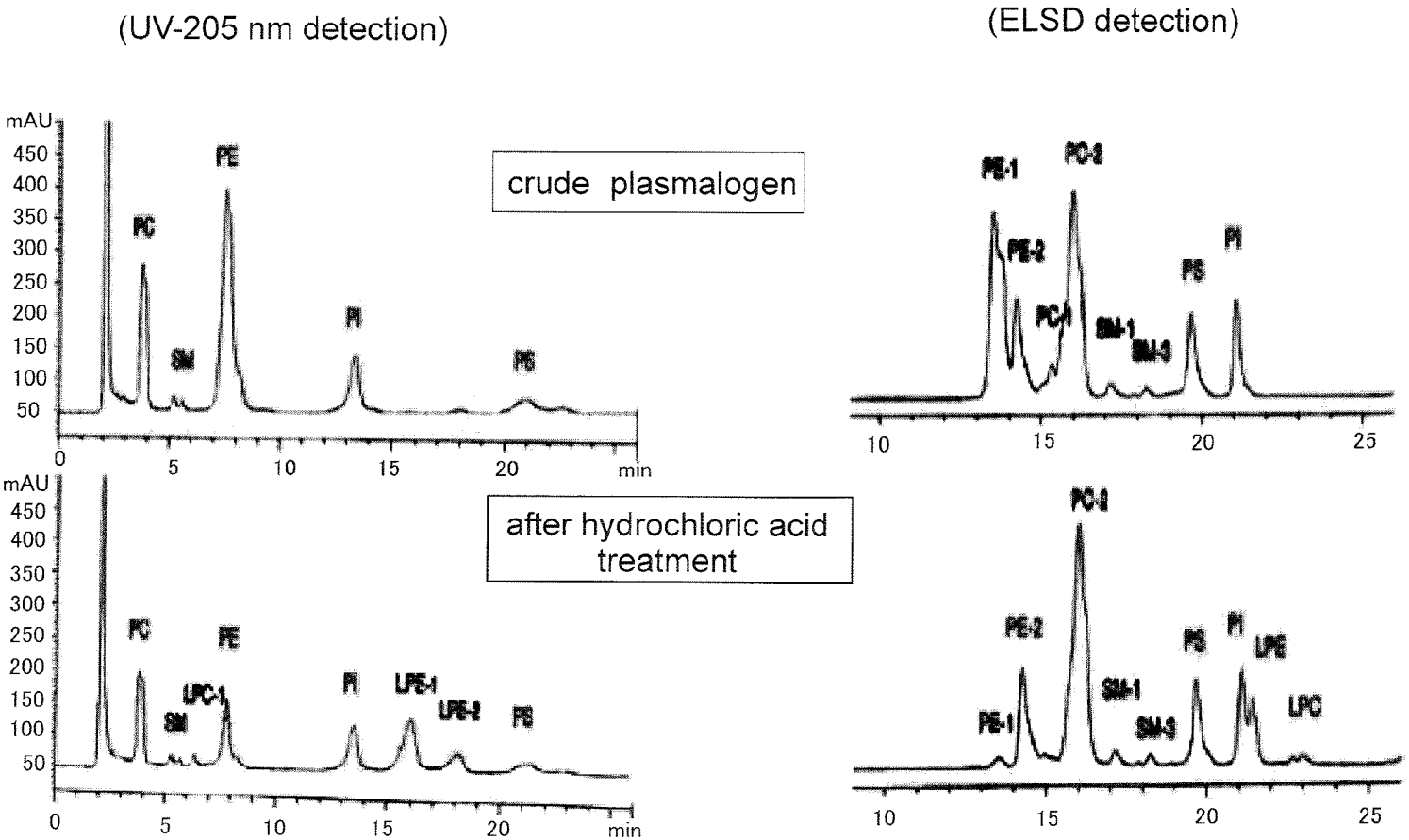
FIG. 2 shows UV-205 nm detection chromatograms and ELSD detection chromatograms of a crude plasmalogen obtained the process of this invention and the crude plasmalogen after hydrochloric acid treatment.

FIG. 2 shows UV-205 nm detection chromatograms and ELSD detection chromatograms of a crude plasmalogen obtained by the above method and the crude plasmalogen after hydrochloric acid treatment. In a calculation from the UV-205 nm detection chromatogram, it Is shown that approximately 80 mass % of PE and approximately 30 mass % of PC are plasmalogen.

(Note: ELSD, evaporate light scattering; UV, ultraviolet light; PC, phosphatidyicholine; SM, sphingomyelin; PE, phosphatidylethanolamine; PS, phosphatidylserine, PI, phosphtatidylinisitol; LPC, lysophosophatidylcholine; LPS, lysophosphatidyl-ethanolamine).

As explained above, when a precipitate obtained by treating total lipids with 20 mL, per gram of the total lipid, of hexane:acetone (1:1) is subjected to extraction treatment with 20 mL, per gram of the precipitate, of a 50% aqueous acetone solution, most part of an insoluble portion (precipitate) is sphingomyelin. Further, plasmalogen can be recovered from an insoluble portion obtained by drying a hexane-acetone soluble portion and then treating the resultant dried product with 20 mL, per gram of the dried product, of acetone.

INDUSTRIAL UTILITY

According to the process for producing sphingomyelin and plasmalogen-form glycerophospholipid, provided by this invention, a sphingomyelin, in particular, a human-form sphingomyelin and plasmalogen-form glycerophospholipid useful as a functional food material, a medical material, a cosmetic material, etc. can be produced at high yields with simple procedures.

The invention claimed is:

1. A process for producing sphingomyelin and plasmalogen-form glycerophospholipid, which comprises the step (A) of extracting total lipids from a chicken skin powder and drying the extract, the step (B) of subjecting the dried total lipids obtained in said step (A), to extraction treatment with a solvent mixture of an aliphatic hydrocarbon solvent and a water-soluble ketone solvent to separate an insoluble portion composed mainly of sphingomyelin and a soluble portion, the step (C) subjecting the insoluble portion composed mainly of sphingomyelin, obtained in said step (B), to extraction treatment with a solvent mixture of water and a water-soluble ketone solvent to remove a non-lipid component contained in the soluble portion, and the step (D) of drying the soluble portion obtained in said step (B), and subjecting the thus-obtained dried product to extraction treatment with a water-soluble ketone solvent to separate and recover an insoluble portion composed mainly of plasmalogen-form glycerophospholipid.

2. The process of claim 1, wherein the solvent mixture in the step (B) contains n-hexane and acetone at a volume ratio of 4:6 to 6:4, and its use amount is 10 to 30 mL per gram of the dried total lipids.

3. The process of claim 1, wherein the water-soluble ketone solvent in the step (C) is acetone and the solvent mixture contains water and acetone at a volume ratio of 3:7 to 7:3, and its use amount is 10 to 30 mL per gram of a dried product from the insoluble portion composed mainly of sphingomyelin, obtained in the step (B).

4. The process of claim 1, wherein the water-soluble ketone solvent in the step (D) is acetone, and its use amount is 10 to 30 mL per gram of a dried product from the soluble portion obtained in the step (B).

* * * * *